US010836027B2

(12) United States Patent
Yang et al.

(10) Patent No.: US 10,836,027 B2
(45) Date of Patent: Nov. 17, 2020

(54) HAND-HELD ELECTRIC POWER TOOL

(71) Applicant: Nanjing Chervon Industry Co., Ltd., Nanjing (CN)

(72) Inventors: Qingsong Yang, Nanjing (CN); Wei Wei, Nanjing (CN)

(73) Assignee: Nanjing Chevron Industry Co., Ltd., Nanjing (CN)

( * ) Notice: Subject to any disclaimer, the term of this patent is extended or adjusted under 35 U.S.C. 154(b) by 100 days.

(21) Appl. No.: 16/116,233

(22) Filed: Aug. 29, 2018

(65) Prior Publication Data

US 2019/0099874 A1 Apr. 4, 2019

(30) Foreign Application Priority Data

Sep. 29, 2017 (CN) ..... 2017 1 0910671
Sep. 29, 2017 (CN) ..... 2017 2 1277797 U

(51) Int. Cl.
*B25F 5/00* (2006.01)
*B24B 23/02* (2006.01)
*B24B 47/12* (2006.01)

(52) U.S. Cl.
CPC ..... *B25F 5/008* (2013.01); *B24B 23/028* (2013.01); *B24B 47/12* (2013.01); *B25F 5/001* (2013.01)

(58) Field of Classification Search
CPC ..... B25F 5/008; B25F 5/001; B24B 23/028; B24B 47/12
USPC ..... 310/50, 52, 58, 60 R, 62
See application file for complete search history.

(56) References Cited

U.S. PATENT DOCUMENTS 2,155,082 A * 4/1939 Decker ..... B23B 45/001 173/217
2,452,268 A * 10/1948 Schumann ..... B24B 23/02 173/75
3,302,047 A * 1/1967 Short ..... B25F 5/008 310/60 R
3,829,722 A * 8/1974 Rosenthal, Jr. ..... H02K 9/06 310/50
5,632,578 A * 5/1997 McCurry ..... B23Q 11/005 144/136.95
5,765,652 A * 6/1998 Mathis ..... B25F 5/001 173/216
2005/0008483 A1* 1/2005 Braun ..... F04D 29/282 415/206
2005/0034883 A1* 2/2005 Yamada ..... H02K 7/116 173/217
2008/0090504 A1* 4/2008 Trautner ..... B24B 23/00 451/359
2009/0280732 A1* 11/2009 Esenwein ..... B25F 5/008 451/359
2010/0132968 A1* 6/2010 Hartmann ..... B25F 5/008 173/109
2011/0136420 A1* 6/2011 Chen ..... B24B 23/04 451/488
2014/0147252 A1* 5/2014 Takano ..... B25F 5/008 415/119

(Continued)

*Primary Examiner* — Hemant Desai
*Assistant Examiner* — Christopher Robin Kim
(74) *Attorney, Agent, or Firm* — Greenberg Traurig, LLP

(57) ABSTRACT

A hand-held power tool includes a housing, a motor having a motor shaft, and a fan mounted onto the motor shaft and driven by the motor. The fan has a plurality of large and small fan blades arranged in a staggered form on a surface of the fan. Such arrangement of the fan blades effectively improve the heat dissipation efficiency of the power tool.

8 Claims, 9 Drawing Sheets

(56) References Cited

U.S. PATENT DOCUMENTS

| | | | | |
|---|---|---|---|---|
| 2015/0151422 | A1* | 6/2015 | Kuehne | B24B 23/04 451/344 |
| 2016/0193727 | A1* | 7/2016 | Takeda | B24B 23/028 173/46 |
| 2016/0243693 | A1* | 8/2016 | Chen | B25F 5/008 |
| 2019/0099874 | A1* | 4/2019 | Yang | B24B 23/028 |
| 2020/0055159 | A1* | 2/2020 | Sakai | B25F 5/00 |

* cited by examiner

HAND-HELD ELECTRIC POWER TOOL

CROSS-REFERENCES TO RELATED APPLICATIONS

This application claims the benefit of Chinese patent application No. CN 201710910671.5, filed on Sep. 29, 2017, and Chinese patent application No. CN 201721277797.5, filed on Sep. 29, 2017, the disclosures of which are incorporated herein by reference in their entirety.

TECHNICAL FIELD

The present disclosure relates to a power tool and, more particularly, to a hand-held power tool.

BACKGROUND

Hand-held power tools include angle grinders, which are also known as grinders or disc grinders. Some grinders may be used for cutting or grinding glass fiber plastics and other grinders may be for cutting, grinding, or brushing metal and stone materials.

During the operation of an angle grinder, a high-speed run of the grinder with a long work time will generate a large amount of heat within a housing of the grinder. A fan is used for transferring the heat mainly generated by the motor. If the fan cannot help the grinder to timely and effectively dissipate the heat from the motor, the life of the motor and the associated electronic elements will be greatly affected.

SUMMARY

To address the shortcomings of the prior art, the purpose of the present disclosure is to provide a hand-held power tool that can greatly improve the heat dissipation efficiency thereof.

In order to achieve the foregoing goals, the present disclosure provides a hand-held power tool. The hand-held power tool includes a housing, a motor in the housing, the motor having a motor shaft, a tool accessory device configured to support a tool accessory, an output shaft for driving the tool accessory and arranged substantially perpendicular to the output shaft, a transmission mechanism configured to operably connect the motor shaft to the output shaft, a fan mounted onto the motor shaft and configured to be driven by the motor, and a guide cover configured to receive the fan therein. The housing has an air inlet and an air outlet, an external air flow flows through the motor and the fan via the air inlet and out of the housing via the air outlet. The fan has a fan surface with a plurality of large and small fan blades thereon, the large fan blades and the small fan blades are arranged such that each of the small fan blades is located between every two adjacent large fan blades. Each of the large fan blades and the small fan blades has a respective head located adjacent to the motor shaft, and a respective tail located away from the motor shaft. The head of the large fan blade is disposed closer to the motor shaft along a radial direction of the fan than the head of the small fan blade. The fan has a fan blade inlet between the heads of the large fan blade and the adjacent small fan blade, and a fan blade outlet between the tails of the large fan blade and the adjacent small fan blade. The fan blade inlet and the fan blade outlet are arranged such that during operation of the power tool a first inlet velocity at the fan blade inlet is substantially equal to a second outlet velocity at the fan blade outlet.

Further, an opening defined by the heads of the large fan blade and the adjacent small fan may form the fan blade inlet, an opening defined by the tails of the large fan blade and the adjacent small fan blade may form the fan blade outlet, and the fan blade inlet and the fan blade outlet may be substantially equal in size.

Further, the fan may have a fan shaft hole with a fan shaft hole hub, the head of the large fan blades may be about 0.5 cm away from the fan shaft hole hub along the radial direction of the fan, and the head of the small fan blades may be about 1 cm away from the fan shaft hole hub along the radial direction of the fan. Further, a guide attachment piece is arranged between the fan and the guide cover, the guide attachment piece has a plurality of guide baffles extending from a periphery of the fan, the plurality of guide baffles are configured such that the guide baffles induce the air flow coming from the fan toward the air outlet of the housing.

Another example of the present disclosure provides a hand-held power tool. The hand-held power tool includes a housing, a motor in the housing having a motor shaft, and a fan mounted onto the motor shaft and driven by the motor. The housing has an air inlet and an air outlet, an external air flow flows through the motor and the fan via the air inlet and out of the housing via the air outlet. The fan has a plurality of large and small fan blades alternately arranged on a surface of the fan. Each of the large fan blades and the small fan blades has a respective head located adjacent to the motor shaft, and a respective tail located away from the motor shaft. The fan has a fan blade inlet between the heads of the large fan blade and the adjacent small fan blade, and a fan blade outlet between the tails of the large fan blade and the adjacent small fan blade. The fan blade inlet and the fan blade outlet are arranged such that during operation of said power tool a first inlet velocity at the fan blade inlet is substantially equal to a second outlet velocity at the fan blade outlet.

Further, an opening defined by the heads of the large fan blade and the adjacent small fan may form the fan blade inlet, an opening defined by the tails of the large fan blade and the adjacent small fan blade may form the fan blade outlet, and the fan blade inlet and the fan blade outlet may be substantially equal in size.

Further, the fan may have a fan shaft hole with a fan shaft hole hub, the head of the large fan blades may be about 0.5 cm away from the fan shaft hole hub along the radial direction of the fan, and the head of the small fan blades may be about 1 cm away from the fan shaft hole hub along the radial direction of the fan.

Further, a guide attachment piece may be arranged between the fan and the guide cover, the guide attachment piece having a plurality of guide baffles extending from a periphery of the fan, the plurality of guide baffles being configured such that the guide baffles induce the air flow coming from the fan toward the air outlet of the housing.

Other aspects can be understood after reading and understanding the drawings and detailed description.

DETAILED DESCRIPTION

The following is a detailed description of an embodiment of the present disclosure in combination with the accompanying drawings and specific embodiments.

Figure 1:
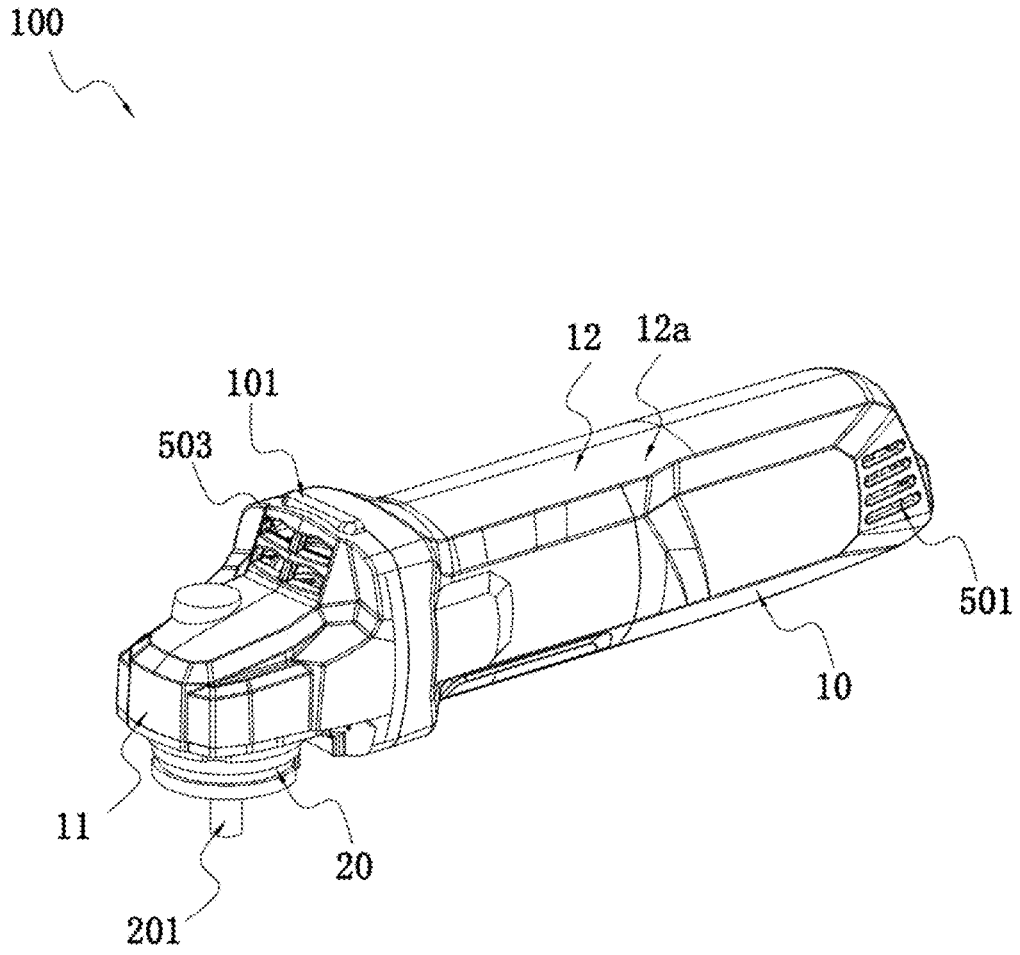
FIG. 1 is a perspective view of an example hand-held electric power tool constructed according to the description that follows.
Figure 2:
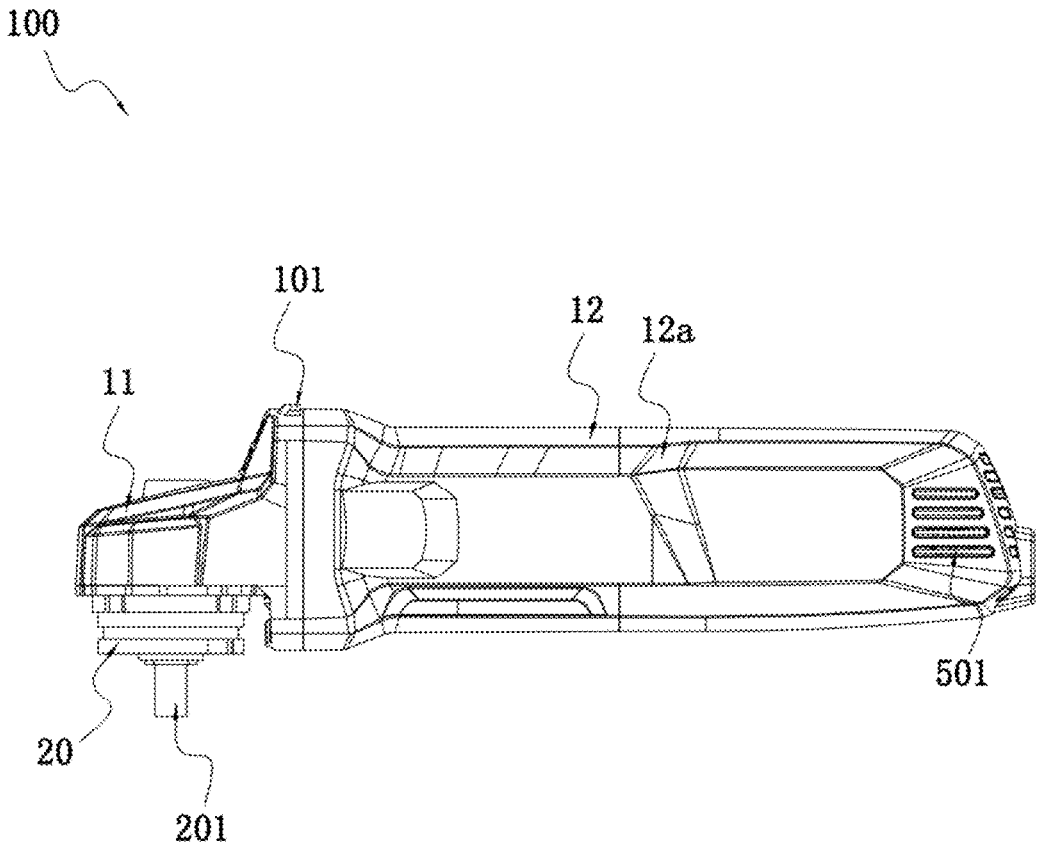
FIG. 2 is a plan view of the electric power tool in FIG. 1.
Figure 3:
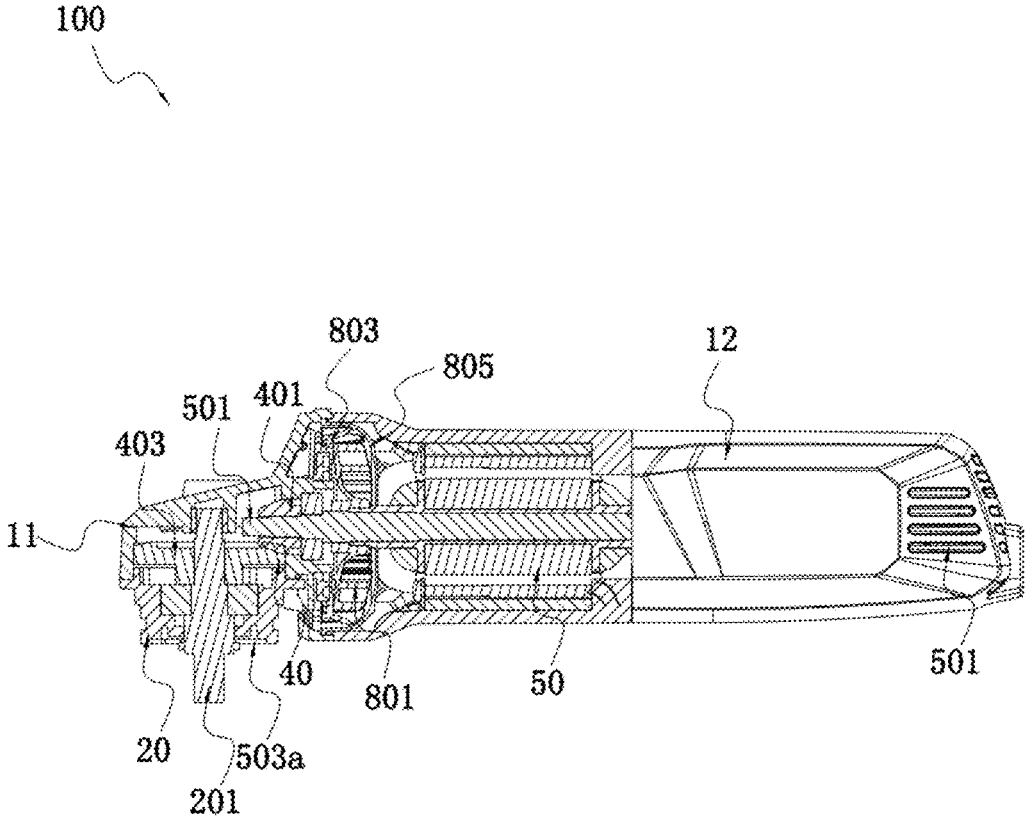
FIG. 3 is a partial cross-sectional view of the electric power tool in FIG. 1.

As shown in FIG. 1 and FIG. 2, a hand-held power tool, for example an angle grinder 100, includes a housing 10, a switch 101 and a tool accessory device 20 configured to support a tool accessory. As shown in FIG. 3, the angle grinder 100 further includes a motor 50 in the housing with a motor shaft, an output shaft 201 for driving the tool accessory, and a transmission mechanism 40 configured to operably connect the motor shaft to the output shaft 201.

As shown in FIG. 2, the housing 2 has the contour of the angle grinder 100, and also forms a hand-held case 12*a*. The hand-held case 12*a* forms a gripping surface on the housing, for example, by providing a plurality of convex ribs to increase friction. The housing 10 includes a head housing 11 and a handle housing 12. In an example, the motor 50, a circuit board and electronic components are mounted in the handle housing 12.

The head housing 11 is connected to one end of the handle housing 12. The head housing 11 is further used for mounting the output shaft 201. As one part of the housing 10, the head housing 11 is opened to the outside such that the output shaft 201 and the tool accessory tool accessory device 20 is at least partially exposed to the housing 10.

The handle shell 12 may include a motor housing and a component housing. In this embodiment, the motor housing and the component housing are integrally formed, and make up the handle housing 12. For the handle housing 12, the hand-held case or part 12*a* is considered as a part of the handle housing 12 that is suitable for the users to hold. For example, in this example, an end of the handle housing 12 connected with head housing 11 is larger than the other parts of the handle housing 12. Thus, the relatively small part of the handle housing 12 is more suitable for the users to hold. In this case, the relatively small part may be considered as the hand-held case or part 12*a*. In this case, a length of the hand-held case 12*a* may be considered to be shorter than that of the handle housing 12. Of course, the present disclosure is not limited to this, the whole handle housing 12 can be considered as the hand-held case 12*a*. For another example, when the overall thickness of the handle housing 12 is relatively consistent, the whole handle housing 12 is suitable for the users to hold. At this time, the whole of the handle housing 12 is considered as the hand-held case 12*a*. The length of the hand-held case 12*a* may be considered to be consistent with the length of the handle housing 12. In addition, the hand-held case 12*a* and the handle housing 12 may be made of the same material. Alternatively, the hand-held case 12*a* and the handle housing 12 may be made of different materials. For example, the hand-held case 12*a* is made of plastic material, the handle housing 12 is made of rubber material, the hand-held case 12*a* and the handle housing 12 are molded together. Alternatively, the handle housing 12 is made of plastic material, and a certain area of the hand-held case 12*a* is provided with rubber or other material, which is not limited here.

The switch 101 is generally mounted on the handle housing 12, so that when the user holds the hand-held case 12*a*, the user can conveniently press or trigger the switch 101. The switch 101 may serve as a main switch for starting the angle grinder 100, and other auxiliary switches may be arranged in other areas of the handle housing 12*a*, or other auxiliary switches may be arranged on a housing except for the handle housing 12, which is convenient for the users to use in specific work conditions.

A power supply is configured to supply power for the angle grinder 100. The power supply may be in a form of external alternating current. Of course, the form of direct current may be used, such as a battery pack that can be detachably coupled to the housing 10.

The output shaft 201 is configured to drive the tool accessory device 20 connected to the output shaft 201. The tool accessory device 20 is configured to mount a grinding piece or a cutting piece (not shown). In this way, when the output shaft 201 rotates, the output shaft 201 can drive the tool accessory device 20 to rotate, further drive the grinding piece or the cutting piece to rotate, and then workpieces are cut, and the tool function of the angle grinder 100 is achieved. Specifically, the output shaft 201 is installed on the head housing 11, and at least one part of the output shaft 201 is arranged within the housing 10, and a part of the output shaft 201 is exposed outside of the head housing 11. When the tool accessory device 20 is installed or mounted onto the output shaft 201, the tool accessory device 20 is exposed outside of the head housing 11, thus facilitating the user to remove and install the grinding piece or cutting piece therefrom.

Generally, the angle grinder is provided with a shield which is configured to protect the user when the angle grinder 100 works, and the shield is mounted to the head housing 11. When a grinding piece is mounted to the tool accessory device 20, the shield partially surrounds the grinding piece, such that the grinder classic is effectively prevented from splashing to the user during the operation of the angle grinder, and it is also avoided that the accidentally damaged grinding piece splash to the user.

The motor 50 is mounted in the handle housing 12, the motor 50 is provided with or connected with a motor shaft 501. The transmission mechanism 40 is arranged between the motor shaft 501 and the output shaft 201. The motor 50 outputs power to the transmission mechanism 40 through the motor shaft 501. The transmission mechanism 40 is configured to operably connect the motor shaft 501 to the output shaft 201, and drive the grinding piece on the output shaft 201 to rotate around its output shaft 201.

Specifically, the motor shaft 501 of the motor 50 extends roughly along the axis direction of the motor, and the length direction of the motor shaft 501 may be considered as the axis direction of the motor. In one example, the motor shaft 501 and the output shaft 201 are arranged to be substantially perpendicular to each other. In other example, the motor shaft 501 and the output shaft 201 are arranged roughly in parallel. Of course, in other cases, the motor shaft and output shaft can also be arranged to be inclined with each other.

The transmission mechanism 40, for example, may include a first bevel gear 401 and a second bevel gear 403.

The first bevel gear 401 is installed to the motor shaft 501, and the first bevel gear 401 can rotate synchronously with the motor shaft 501. The second bevel gear 403 is installed to the output shaft 201, and the second bevel gear 403 can rotate synchronously with the output shaft 201. The second bevel gear 403 is engaged with the first bevel gear 401. When the motor shaft 501 rotates, the first bevel gear 401 drives the second bevel gear 403 to rotate, the second bevel gear 403 drives the output shaft 201 to synchronously rotate, thereby realizing a transmission between the motor shaft 501 and the output shaft 201. In addition, the transmission mechanism 40 can be a transmission with two stages, or a transmission with more than two stages, which is not limited here.

The angle grinder 100 further includes a circuit board, and the circuit board is provided with a controller configured to control the motor 50. The circuit board is further provided with a driving switch circuit. The driving switch circuit includes metal oxide semiconductor transistors, and the driving switch circuit is generally provided with six metal oxide semiconductor transistors. The circuit board may be arranged within the hand-held case 12*a* or the housing 12. In an exemplary embodiment, the circuit board is arranged within the handle housing 12. The circuit board may be vertically arranged in the handle housing 12, or arranged on the motor side, so as to make effective and reasonable use of the inner space of the handle housing, the structure is simple and compact.

Figure 4:
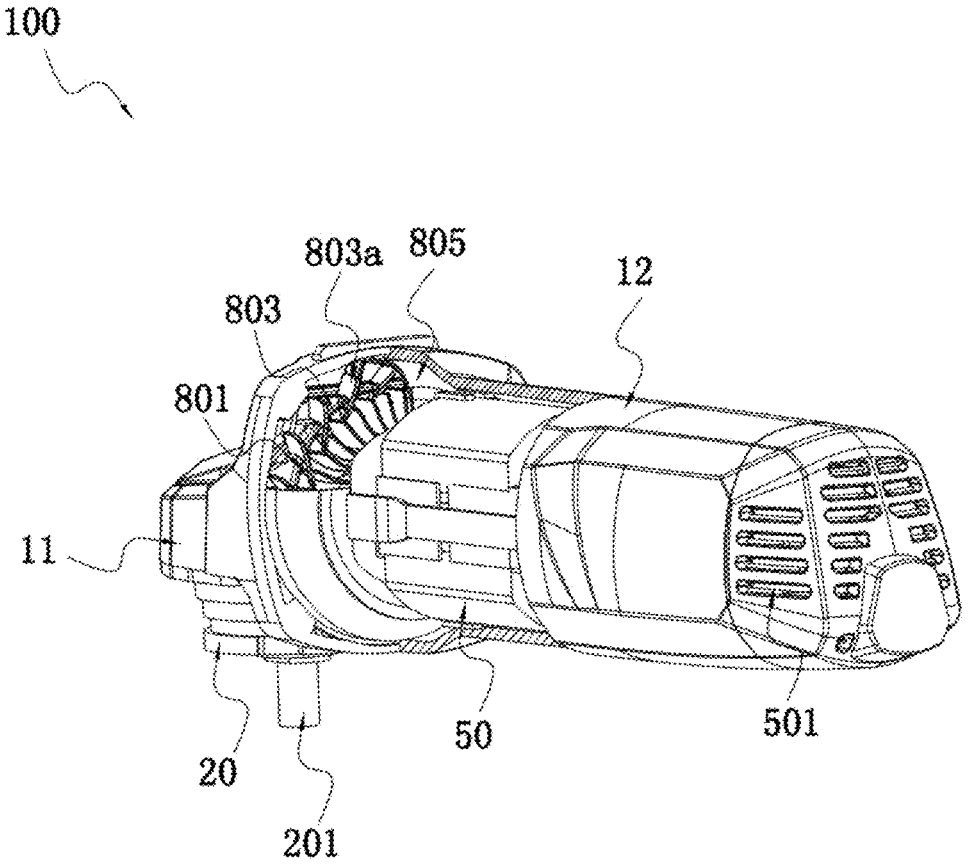
FIG. 4 is another partial cross-sectional view of the electric power tool in FIG. 1.
Figure 5:
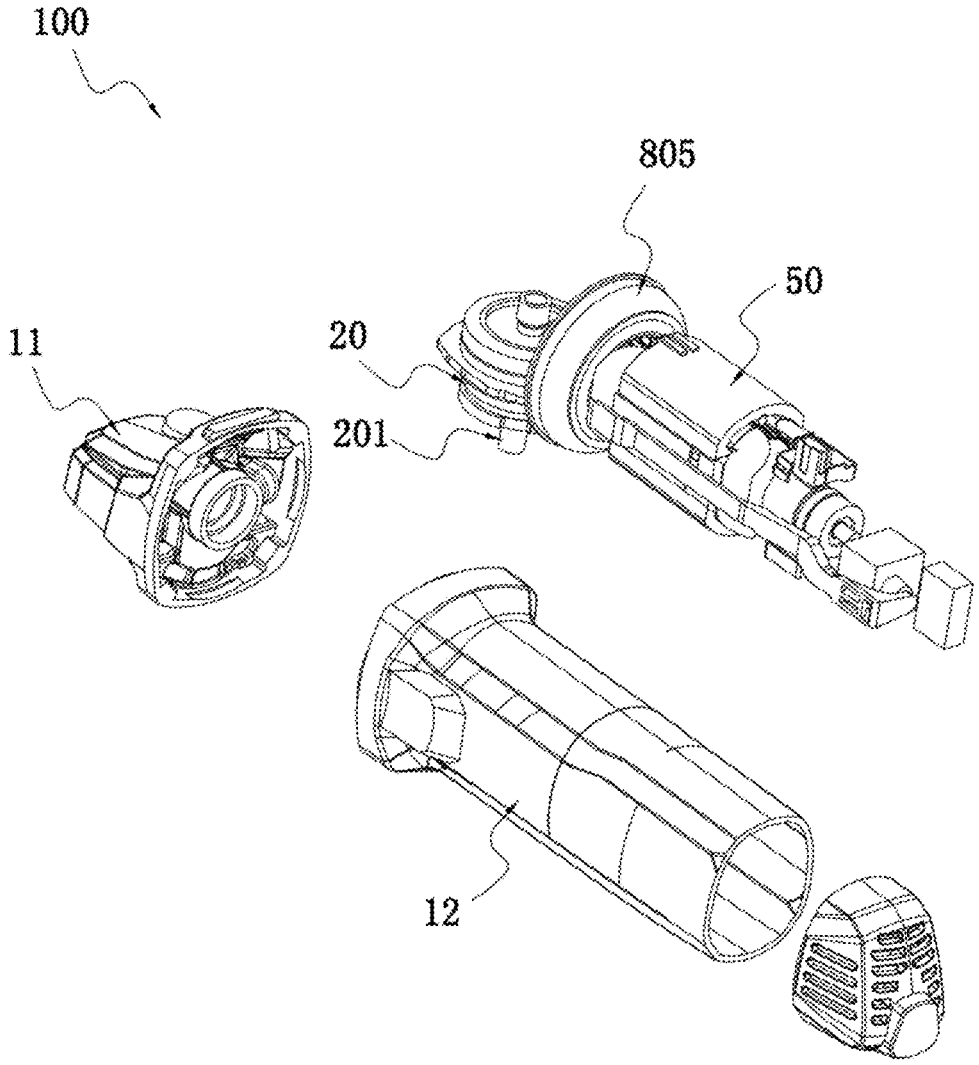
FIG. 5 is an exploded view of the electric power tool in FIG. 1.
Figure 6:
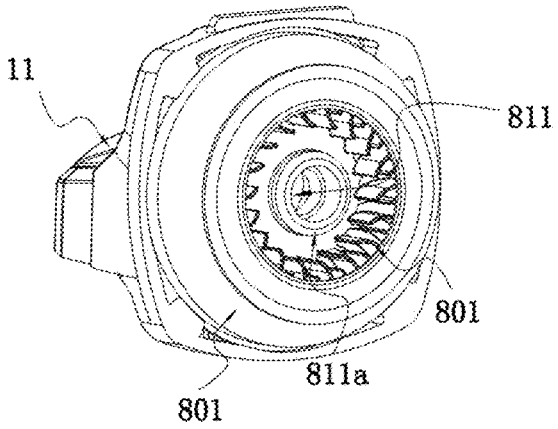
FIG. 6 is a partial perspective view of the electric power tool in FIG. 1.
Figure 7:
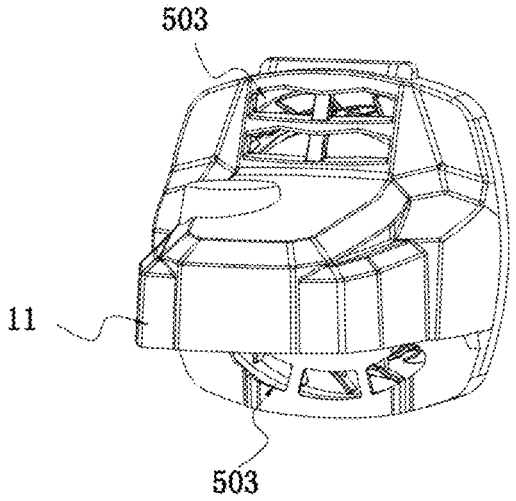
FIG. 7 is another partial perspective view of the electric power tool in FIG. 1.

As shown in FIG. 4, FIG. 5 and FIG. 6, the angle grinder 100 further includes a fan 801 mounted onto the motor shaft and configured to be driven by the motor, a guide attachment piece 803 and a guide cover 805 configured to receive the fan therein. The fan 801, the guide attachment piece 803 and a guide cover 805 are arranged within the housing 10. The housing 10 has an air inlet 501 and an air outlet 503, an external air flow flows through the motor 50 and the fan 801 via the air inlet and out of the housing via the air outlet, and thus the air is guided to the air outlet 503 from the air inlet 501 through the circuit board, electronic components and the motor 50.

In this example, the air inlet 501 is arranged at the rear end of the hand-held case 12*a*, specifically, arranged at the end of the housing. The air outlet 503 is arranged at the front end of the hand-held case 12*a*, that is, arranged on the housing in front of the fan 801, so that the air flow is exported to the outside of the housing through the air outlet 503 for heat dissipation. In addition to the air outlet 503 arranged close to the fan 801, the part of the housing 10 where the tool accessory device 20 is provided is opened as another air outlet 503*a*. The air outlet 503 on the housing and close to the fan 801 is the main air outlet. Since the air outlet 503 is close to the fan 801, the air outlet 503 is easier to be actively driven by the fan 801, and exports most of the hot air, passing through the circuit board, the electronic components, and the motor, to outside of the housing via the main air outlet 503.

As shown in FIG. 3, FIG. 4 and FIG. 6, the fan 801 is an axial fan, and is mounted on the motor shaft 501. The fan 801 is also driven to rotate when the motor 501 is driving. The guide cover 805 is mounted on the housing 10 and is connected with a part of the housing. The motor shaft 501 passes through the guide cover from one side of the guide cover to the other side of the guide cover. The fan 801 is further mounted in the guide cover 805. The side of the guide cover 805, opposed to the tool accessory device 20, is completely opened. The other side of the guide cover, facing to the motor 501, is provided with a through-hole. The size of the through-hole is set so that a large fan blade 801*a* and a small fan blade 801*b* on the fan surface are at least partially exposed. In this example, the head of the large fan blade 801*a* on the fan surface and the head of the small fan blade 801*b* on the fan surface are exposed.

The guide attachment piece 803 is arranged between the fan 801 and the guide cover 805. When the guide attachment piece 803 is arranged on the fan 801, the guide attachment piece 803 includes a plurality of guide baffles 803*a* extending from the periphery of the fan 801. In other words, the fan 801 and the guide attachment piece 803 are arranged inside the guide cover 805. As shown in FIG. 6, the outer diameter of the guide attachment piece 803 with the plurality of guide baffles 803*a* is larger than the outer diameter of the fan 801, the outer diameter of the guide cover 805 is larger than the outer diameter of the guide attachment piece 803 with the plurality of guide baffles 803*a*. In this way, after the fan 801 is placed in the guide cover 805, the guide attachment piece 803 is inserted into the gap between the fan 801 and the guide cover 805. The side of the guide cover 805, opposed to the tool accessory device 20, is completely opened, and the other side, facing to the motor 501, is provided with a through-hole 805*a* with a radius less than that of the completely opened side, which only exposes the heads of the large and small fan blades. With this structure, the guide cover 805 can guide the air flow passing through the circuit board, the electronic components and the motor 501, to the fan 801, and the air flow is exported to the air outlet 503 on the nearby housing by the fan 801. At the same time, the guide cover 805 can effectively prevent the chips and debris generated at the tool accessory device 20 from entering the motor body and affecting the operation of the motor.

Figure 8:
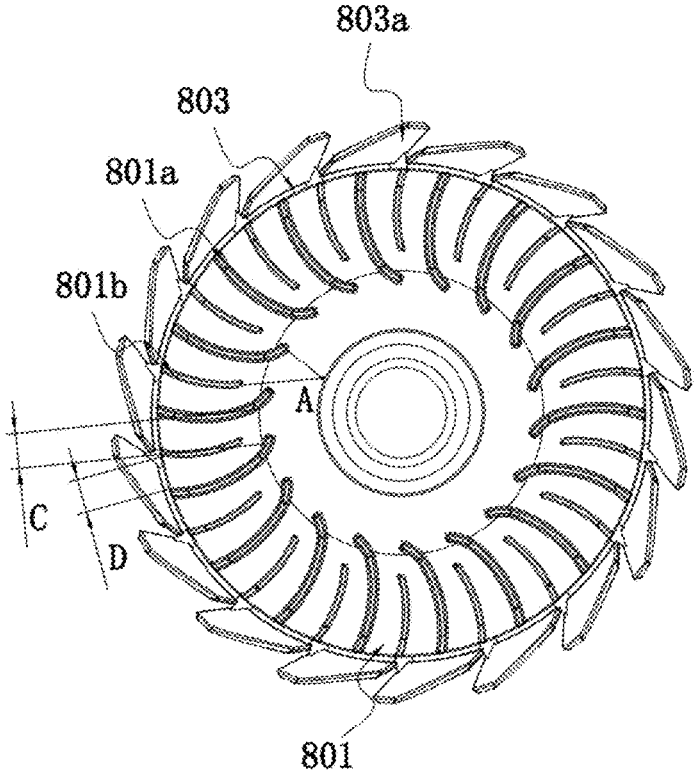
FIG. 8 is a top view of the electric power tool in FIG. 6 in which a fan and a guide attachment piece are mounted together.

As shown in FIG. 4 and FIG. 8, the fan 801 has a fan surface, the fan surface is provided with a plurality of large and small fan blades 801*a*, 801*b*, the large fan blade 801*a* and the small fan blades 801*b* are alternately arranged, e.g., in a staggered form, on the surface of the fan. In other words, the large fan blades 801*a* and the small fan blades 801*b* are arranged such that each of the small fan blades is located between every two adjacent large fan blades. Each of the large fan blades and the small fan blades has a respective head located adjacent to the motor shaft, and a respective tail located away from the motor shaft. The head of the large fan blade is disposed closer to the motor shaft along a radial direction of the fan than the head of the small fan blade. The fan has a fan blade inlet C between the heads of the large fan blade 801*a* and the adjacent small fan blade 801*b*, and a fan blade outlet D between the tails of the large fan blade 801*a* and the adjacent small fan blade 801*b*. The fan 801 has a fan shaft hole 811 mounted on the motor shaft 501, and the fan shaft hole 811 of the fan is provided with a fan shaft hole hub 811*a*. The head of the large fan blade 801*a* is about 0.5 cm away from the fan shaft hole hub 811*a* along the radial direction of the fan, and the head of the small fan blade 801*b* is about 1 cm away from the fan shaft hole hub 811*a* along the radial direction of the fan. In this way, the head of the large fan blade 801*a* is disposed closer to the motor shaft 501 than the head of the small fan blade 801*b* in the radial direction of the fan. In an example, an opening defined by the heads of the large fan blade 801*a* and the adjacent small fan 801*b* forms the fan blade inlet C, an opening defined by the tails of the large fan blade 801*a* and the adjacent small fan blade 801*b* forms the fan blade outlet D, and the fan blade inlet C and the fan blade outlet D are substantially equal in size. In this example, the size of the fan blade inlet C is 3.1 mm, but the size of the fan blade outlet D may be 3.5 mm, 3.6 mm or 3.8 mm, so the fan blade inlet C and the fan blade outlet D are considered to be approximately or substantially equal in size. In another example, the fan blade inlet C is formed between the heads of the large fan blade 801*a* and the adjacent small fan blade 801*b*, the fan blade outlet D is formed between the tails of the large fan blade 801*a* and the adjacent small fan blade 801*b*. Thus, the fan blade inlet C and the fan blade outlet D are arranged such that during operation of the power tool a first inlet velocity at the fan blade inlet is approximately or substantially equal to a second outlet velocity at the fan blade outlet.

In the prior art arts, the fan blades have the same size and are arranged at intervals, the fan blade outlet formed at the tails of the fan blades is much larger than the fan blade inlet formed at the heads of the fan blades. Because the size of the fan blade inlet is small, an air flow interference area is formed at the fan blade inlet, the air flow further enters a flow passage defined between the fan blades and then escape the fan blade outlet. Due to the size of the fan blade outlet being much larger than that of the fan blade inlet, the air flow at the fan blade outlet was to return or rotate due to the air flow having a loss of pressure and an air flow vortex forms at the a low speed area of the fan blade outlet, and leads to energy loss of the air flow. On the one hand, the air flow vortex will cause some resistance to the fan and affect the working efficiency of the fan. On the other hand, it is not beneficial for the hot air flow to be effectively exported via the air outlet 503 of the housing. In the subject, described power tool, a small fan blade 801*b* is added into the flow passage between the two adjacent large fan blades 801*a*, which configuration can effectively reduce the size of the fan blade outlet D and enable the fan blade inlet C and the fan blade outlet D to be approximately equal in size. Thus, the air flow vortex disappears at the fan blade outlet, and the fan flow is increased.

Figure 10:
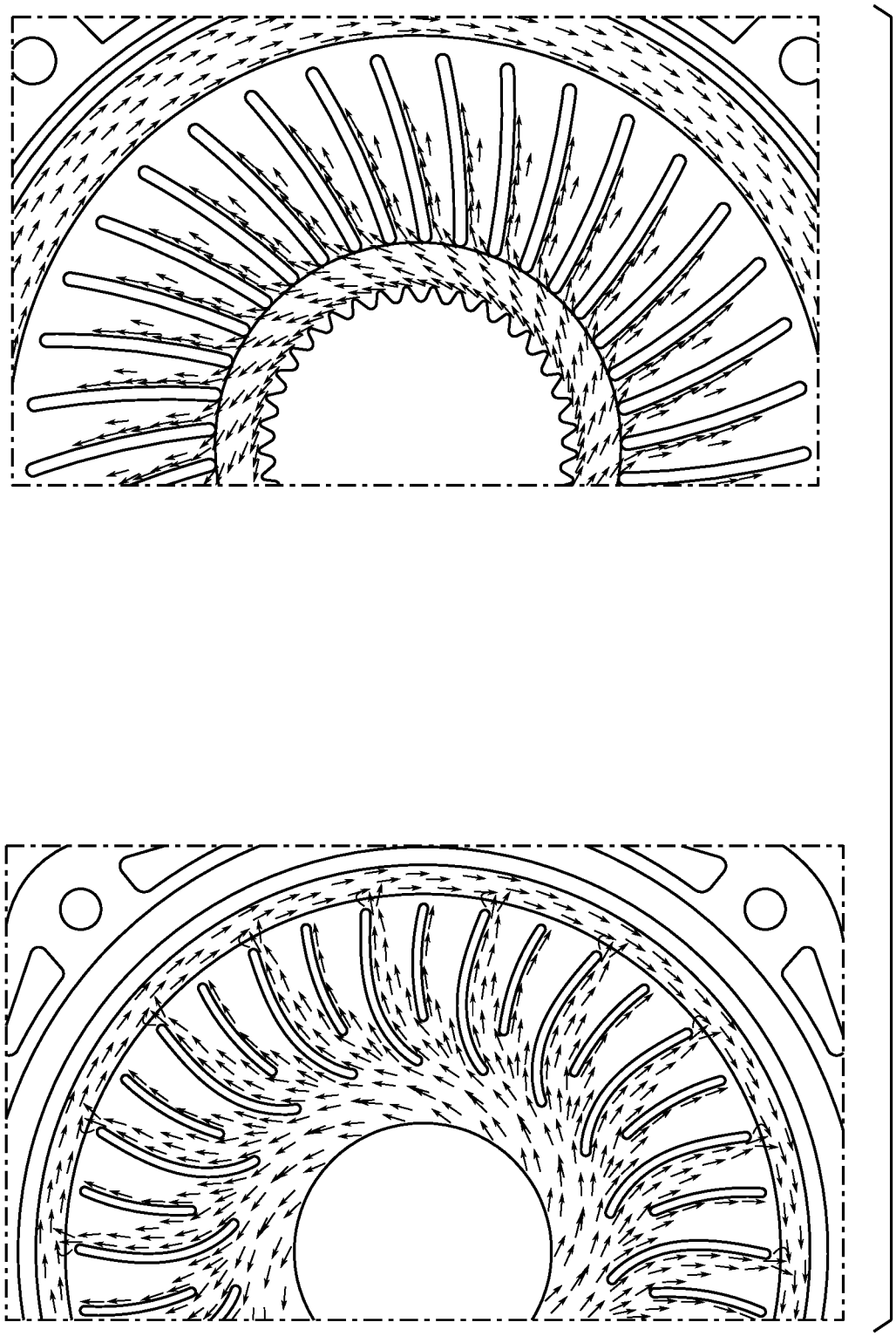
FIG. 10 is a diagram illustrating a simulation of an air flow at a fan of the electric power tool in FIG. 6.

Simulation of air flows are shown in FIG. 10. The top drawing shows the air flow of the prior art, wherein the inlet velocity at the fan blade inlet is much larger than the outlet velocity at the fan blade outlet. In other words, the outlet velocity at the fan blade outlet was very small. The bottom drawing shows the simulation of the air flow achieved by the examples described herein where the air flow has a first inlet velocity at the fan blade inlet C and has a second outlet velocity at the fan blade outlet D, and the first inlet velocity is approximately or substantially equal to the second outlet velocity. It is noted, in an actual diagram for the air flow simulation, the flow velocity are marked with different colors showing different speeds thereof, the color of velocity at the fan blade inlet is approximately the same as that at the outlet of fan blade, indicating the first inlet velocity at the fan blade inlet C is substantially equal to the second outlet velocity at the fan blade outlet D. In this way, the air flow enters via the fan blade inlet C and exports via the fan blade outlet D with a constant speed, and the energy of the air flow will not be greatly lost.

As above, the guide attachment piece 803 is arranged between the fan 801 and the guide cover 805. When the guide attachment piece 803 is arranged on the fan 801, the guide attachment piece 803 has a plurality of guide baffles 803*a* extending from a periphery of the fan 801. The guide baffles 803*a* are configured such that the guide baffles 803*a* induce the air flow coming from the fan 801 toward the air outlet 503 of the housing.

Specifically, viewed from the top view of the guide attachment piece 803 and the fan 801 assembled, the guide attachment piece 803 is configured in a manner such that the guide baffles 803*a* are set to extend along the periphery of the fan surface with roots of the guide baffles 803*a* extending from one large fan blade or small fan blade, tails of the guide baffles 803*a* extending to the adjacent large fan blade or small fan blade. That is, the head of the large fan blade 801*a* is about 0.5 cm away from point A of the fan shaft hole hub 811*a* along the radial direction, and the large fan blade 801*a* is curved in a shape from its head to its tail, and the tail of the large fan blade 801*a* is much lower away from the same point A compared to the head of the large fan blade 801*a*. The small fan blade 801*b* is arranged between two large fan blades 801*a*, and the small fan blade 801*b* is curved in a shape similar to that of the large fan blade 801*a*. The head of the small fan blade 801*b* is about 1 cm away from the fan shaft hole hub 811*a* along the radial direction of the fan. As shown in FIG. 8, in the top view in which the guide attachment piece 803 and the fan 801 are assembled, the angle between the tangent of the arc-shaped large fan blade 801*a* and the tangent of the arc-shaped guide baffle 803*a* is about 90 degrees. In this way, the guide baffle 803*a* of the guide attachment piece 803 can effectively direct the hot air flow hovering between the fan 801 and the guide cover towards the air outlet 503 of the housing to discharge, thus greatly improving the heat dissipation effect.

Figure 9:
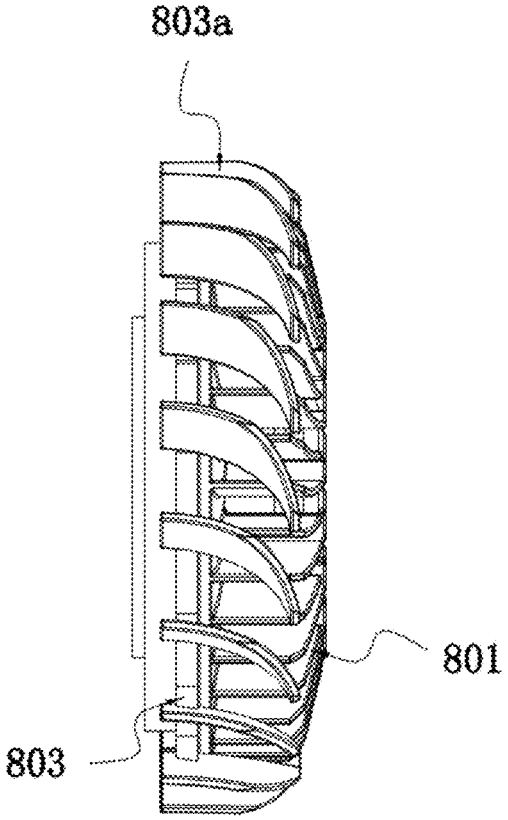
FIG. 9 is a side view of the electric power tool in FIG. 6 in which the fan and the guide attachment piece are mounted together.

As shown in FIG. 9, viewed from the side view in which the guide attachment piece 803 and the fan 801 are assembled, the guide baffles 803*a* are further configured in such a manner that the guide baffles 803*a* are set to extend with wide roots, spaced apart by one fan blade, and to be reduced to sharp tails. In this way, the configuration of the guide baffle 803*a* does benefit the export of the hot air flow hovering between the fan 801 and the guide cover 805, to the air outlet 503 of the housing by the induce of the guide baffle 803*a*.

Comparing with the prior art, in the subject power tool, the root or head of the large fan blade 801*a* and the root or head of the small fan blade 801*b* are further away from the fan shaft hole 811, which indirectly increases the fan inlet area and thus does less interference of the fan blade to the fan inlet.

The foregoing examples take an angle grinder as example, but the present disclosure is not limited to an angle grinder, and may be used in any other fan mounted on the motor shaft, without limitation here.

The foregoing shows and describes the basic principle, main features and advantages of the present disclosure. Those skilled in the art should understand that the foregoing examples are not intended to limit the present disclosure in any way. Rather, technology solutions obtained by equivalent substitution or equivalent conversion shall fall within the protection scope of the following claims.

What is claimed is:

1. A hand-held power tool, comprising:

a housing;

a motor positioned in the housing, the motor having a motor shaft rotatable about an axis;

a tool accessory device configured to support a tool accessory;

an output shaft for driving the tool accessory and arranged substantially perpendicular to the motor shaft;

a transmission mechanism configured to operably connect the motor shaft to the output shaft;

a fan mounted onto the motor shaft and configured to be driven by the motor; and a guide cover configured to receive the fan therein, wherein the housing has an air inlet and an air outlet, an air flow flows through the air inlet, the motor, the fan, and the air outlet, wherein the fan has a fan surface with a plurality of large fan blades and a plurality of small fan blades positioned thereon, each of the small fan blades being located between every two adjacent large fan blades, the fan further comprises a fan shaft hole hub which forms a fan shaft hole through which the motor shaft passes, wherein each of the large fan blades has a first head proximate to the motor shaft and a first tail end distal from the motor shaft and each of the small fan blades has a second head end proximate to the motor shaft and a second tail end distal from the motor shaft, wherein a first gap is formed between the first head end and the fan shaft hole hub, a second gap is formed between the second head end and the fan shaft hole hub, the first gap is smaller than the second gap so that the first head is disposed closer to the motor shaft than the second head, wherein the fan has a fan blade inlet formed between the first head end of one of the large fan blades and the first head end of another adjacent large fan blade, the fan blade inlet is open in a radial direction of the fan, and the fan further has a fan blade outlet formed between the first tail end of one of the large fan blades and the second tail end of one of the small fan blades adjacent to the one of the large fan blades, and wherein the fan blade inlet and the fan blade outlet are arranged such that, during operation of the power tool, a first inlet velocity at the fan blade inlet is substantially equal to a second outlet velocity at the fan blade outlet.

2. The hand-held power tool according to claim 1, wherein the size of the fan blade inlet and the size of the fan blade outlet are substantially equal.

3. The hand-held power tool according to claim 1, wherein the first head end of the large fan blades is 0.5 cm away from the fan shaft hole hub along the radial direction of the fan, and the second head end of the small fan blades is 1 cm away from the fan shaft hole hub along the radial direction of the fan.

4. The hand-held power tool according to claim 3, wherein a guide attachment piece is arranged between the fan and the guide cover, the guide attachment piece has a plurality of guide baffles extending from a periphery of the fan, and the plurality of guide baffles are configured such that the guide baffles induce the air flow coming from the fan toward the air outlet of the housing.

5. A hand-held power tool, comprising:

a housing;

a motor positioned in the housing, the motor having a motor shaft; and a fan mounted onto the motor shaft and driven by the motor, wherein the housing has an air inlet and an air outlet and an external air flow flows through the motor and the fan via the air inlet and out of the housing via the air outlet, wherein the fan has a plurality of large fan blades and a plurality of small fan blades alternately arranged on a surface of the fan, and the fan further comprises a fan shaft hole hub forming a fan shaft hole through which the motor shaft passes, wherein each of the large fan blades has a first head end proximate to the motor shaft and a first tail end distal from the motor shaft, and each of the small fan blades has a second head end located proximate to the motor shaft and a second tail end distal from the motor shaft, wherein a first gap is formed between the first head end and the fan shaft hole hub, and a second gap is formed between the second head end and the fan shaft hole hub, the first gap being smaller than the second gap such that the first head end is disposed closer to the motor shaft than the second head end, and wherein the fan has a fan blade inlet formed between the first head end of one of the large fan blades and the first head end of another adjacent large fan blades, the fan blade inlet is open in a radial direction of the fan, the fan further has a fan blade outlet formed between the first tail end of the one of the large fan blades and the second tail end of one of the small fan blades adjacent to the one of the large fan blades, and the size of the fan blade inlet is substantially equal to the size of the fan blade outlet.

6. The hand-held power tool according to claim 5, wherein the first head end of the large fan blades is 0.5 cm away from the fan shaft hole hub along the radial direction of the fan, and the second head end of the small fan blades is 1 cm away from the fan shaft hole hub along the radial direction of the fan.

7. The hand-held power tool according to claim 6, wherein a guide attachment piece is arranged between the fan and the guide cover, the guide attachment piece has a plurality of guide baffles extending from a periphery of the fan, and the plurality of guide baffles are configured such that the guide baffles induce the air flow coming from the fan toward the air outlet of the housing.

8. A hand-held power tool, comprising:

a housing;

a motor positioned in the housing, the motor having a motor shaft capable of rotating around an axis;

a tool accessory device configured to support a tool accessory;

an output shaft for driving the tool accessory and arranged substantially perpendicular to the motor shaft;

a transmission mechanism configured to operably connect the motor shaft to the output shaft;

a fan mounted onto the motor shaft and configured to be driven by the motor;

a guide cover configured to receive the fan therein;

wherein the housing has an air inlet and an air outlet, an air flow flows through the air inlet, the motor, the fan and the air outlet;

wherein the fan has a fan surface with a plurality of large fan blades and small fan blades positioned thereon, each of the small fan blades is located between every two adjacent large fan blades, the fan further comprises a fan shaft hole hub which forms a fan shaft hole through which the motor shaft passes;

wherein each of the large fan blades has a first head end close the motor shaft and a first tail end away from the motor, and each of the small fan blades has a second head end close to the motor shaft and a second tail end away from the motor shaft;

wherein a first gap is formed between the first head end and the fan shaft hole hub, a second gap is formed between the second head end and the fan shaft hole hub, the first gap is smaller than the second gap so that the first head end is disposed closer to the motor shaft than the second head end; and wherein the fan has a fan blade inlet formed between the first head end of one of the large fan blades and the first head end of another adjacent large fan blades, the fan blade inlet is open in a radial direction of the fan, and the fan further has a fan blade outlet formed between the first tail end of the one of the large fan blades and the second tail end of one of the small fan blades adjacent to the one of the large fan blades.

* * * * *